United States Patent [19]

Poppendiek

[11] 4,313,342

[45] Feb. 2, 1982

[54] METHOD AND APPARATUS FOR DETERMINING VERTICAL HEAT FLUX OF GEOTHERMAL FIELD

[75] Inventor: Heinz F. Poppendiek, LaJolla, Calif.

[73] Assignee: The United States of America as represented by the United States Department of Energy, Washington, D.C.

[21] Appl. No.: 129,433

[22] Filed: Mar. 11, 1980

[51] Int. Cl.[3] ..... E21B 49/00

[52] U.S. Cl. ..... 73/154

[58] Field of Search ..... 73/154, 343.5, 344, 73/343 R

[56] References Cited

U.S. PATENT DOCUMENTS

| | | | |
|---|---|---|---|
| 3,668,927 | 6/1972 | Howell et al. | 73/154 |
| 3,714,832 | 2/1973 | Howell et al. | 73/432 R |
| 3,807,227 | 4/1974 | Smith, Jr. | 73/154 |
| 3,808,889 | 5/1974 | Rawson et al. | 73/154 |
| 3,864,969 | 2/1975 | Smith, Jr. | 73/154 |
| 3,981,187 | 9/1976 | Howell | 73/154 |

FOREIGN PATENT DOCUMENTS

| | | | |
|---|---|---|---|
| 135746 | 5/1979 | Fed. Rep. of Germany | 73/154 |

OTHER PUBLICATIONS

Christoffel, D. A. et al., A Geothermal Heat Flow . . . Conductivity Journal of Scientific Instruments, 1969, Series 2, vol. 2, pp. 457–465.

*Primary Examiner*—Jerry W. Myracle

*Attorney, Agent, or Firm*—Clifton E. Clouse, Jr.; Roger S. Gaither; Richard G. Besha

[57] ABSTRACT

A method and apparatus for determining vertical heat flux of a geothermal field, and mapping the entire field, is based upon an elongated heat-flux transducer (10) comprised of a length of tubing (12) of relatively low thermal conductivity with a thermopile (20) inside for measuring the thermal gradient between the ends of the transducer after it has been positioned in a borehole for a period sufficient for the tube to reach thermal equilibrium. The transducer is thermally coupled to the surrounding earth by a fluid annulus, preferably water or mud. A second transducer comprised of a length of tubing of relatively high thermal conductivity is used for a second thermal gradient measurement. The ratio of the first measurement to the second is then used to determine the earth's thermal conductivity, $k_\infty$, from a precalculated graph, and using the value of thermal conductivity thus determined, then determining the vertical earth temperature gradient, b, from predetermined steady state heat balance equations which relate the undisturbed vertical earth temperature distributions at some distance from the borehole and earth thermal conductivity to the temperature gradients in the transducers and their thermal conductivity. The product of the earth's thermal conductivity, $k_\infty$, and the earth's undisturbed vertical temperature gradient, b, then determines the earth's vertical heat flux. The process can be repeated many times for boreholes of a geothermal field to map vertical heat flux.

13 Claims, 6 Drawing Figures

METHOD AND APPARATUS FOR DETERMINING VERTICAL HEAT FLUX OF GEOTHERMAL FIELD

The U.S. Government has rights in this invention pursuant to Contract No. E(04-3)-1318 between the U.S. Department of Energy and Geoscience Limited.

BACKGROUND OF THE INVENTION

The invention relates to a method and apparatus for mapping the vertical heat flux of a geothermal field, and more particularly to a rod heat-flux transducer for in situ probing of the vertical heat flux under steady state conditions.

The thermal properties of earth are of considerable importance to the geologist engineer, and others engaged in the study and application of the earth sciences. Geothermal heat flux is a parameter of particular importance in efforts to develop geothermal power as a source of energy because a first step in such development relates to the assessment of the amount of energy available in the earth at particular locations.

A convenient way to determine heat flux in situ requires drilling a borehole, or using an existing borehole, to lower a transducer to desired depths in the earth. This technique is referred to in U.S. Pat. No. 3,714,832. While the technique is basically sound, there are problems because the cased or uncased walls are so irregular as to prevent a transducer of any length to be inserted, particularly if the transducer is to be in physical contact with the walls in at least two vertically displaced points in order to measure thermal gradients. Different techniques have been utilized to overcome this problem, such as the use of a spring device to keep the transducer sensors in contact with the wall, as disclosed in U.S. Pat. No. 3,714,832, or the use of a pad member as disclosed in U.S. Pat. No. 3,807,227. Resorting to these techniques has resulted from a belief that it is necessary for the transducer to have physical contact with the borehole walls.

OBJECTS AND SUMMARY OF THE INVENTION

An object of this invention is to provide a method of measuring geothermal heat flux in boreholes by means of a transducer without the need of measuring separately the vertical temperature gradient in place and the thermal conductivity of a core sample in a laboratory, i.e., by means of a transducer which measures heat flux in situ.

A further object is to provide a transducer to measure the earth thermal conductivity in a borehole without requiring that the transducer be pressed against the earth bounding the borehole.

These and other objects of the invention are achieved by use of a rod heat-flux transducer system which consists of two elongated rods of different but known thermal conductivity. One rod is maintained in one position for a period sufficient for it to be in thermal equilibrium with the surrounding earth, and then the temperature gradient of the rod along its length is measured, preferably with thermopiles. The second rod is simultaneously or subsequently also maintained in about the same position for a period sufficient for the second rod to be in thermal equilibrium with the surrounding earth, and then its temperature gradient is similarly measured along its length. The measured thermal gradient of the first rod and its known thermal conductivity is then related to the measured thermal gradient of the second rod and its known thermal conductivity to obtain the vertical heat flux in the surrounding earth. The process may be repeated at different depths and in adjacent boreholes to map the heat flux to a greater depth and over a larger area of a geothermal field. Each rod is preferably a cylinder sufficiently long for it to have a measureable temperature gradient after it reaches equilibrium in the borehole, and may have a diameter nearly the same as the borehole, but sufficiently less to leave a fluid annulus around the transducer, thereby avoiding the problems of the prior art with respect to maintaining contact without jamming the rods in the borehole.

The novel features that are considered characteristic of this invention are set forth with particularly in the appended claims. The invention will best be understood from the following description when read in conjunction with the accompanying drawings.

Figure 1:
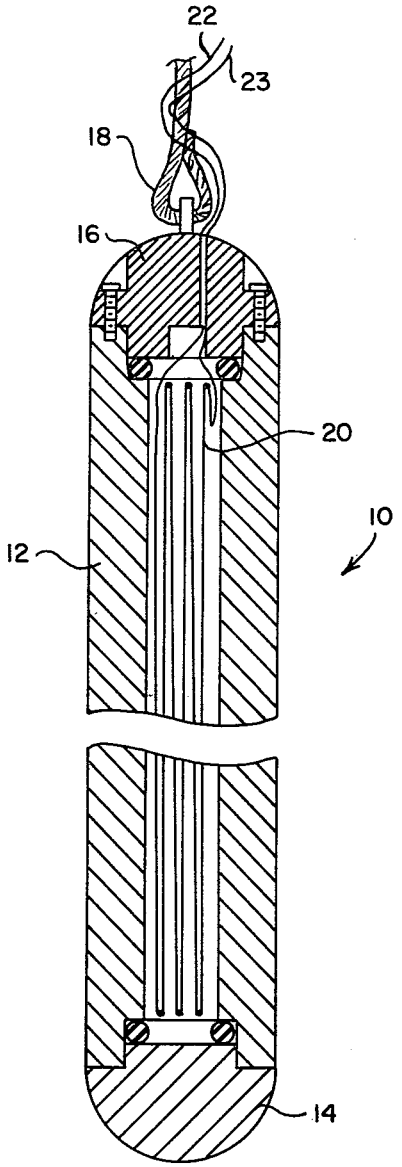
FIG. 1 illustrates schematically a cylindrical rod heat-flux transducer of the present invention.

Reference will now be made in detail to the present preferred embodiment of the invention, an example of which is illustrated in the accompanying drawings.

DESCRIPTION OF PREFERRED EMBODIMENTS

This invention is based on the principle that there is steady-state, two-dimensional heat transfer in the earth and a cylindrical rod located in a borehole. The two dimensions are vertical distance (from the rod transducer midpoint) and radial distance (from the rod transducer centerline). Complex two-dimensional, two-component heat transfer analysis solutions (finite-difference solutions) were performed with a computer using the Laplace heat conduction equation with a series of applicable boundary conditions, where the two components are the rod and its surrounding earth. A simpler closed-form solution (described below) was also derived which satisfactorily approximated the finite-difference solution.

Consider an idealized rod heat-flux transducer. A steady state heat balance on a differential element of the rod which is transferring heat to or from the surrounding infinite solid (the earth) through a radial thermal resistance is given by the classical equation $$\frac{d^2t}{dz^2} = \frac{P}{R_\infty kA}(t - t_\infty) \quad (1)$$

where:

t, rod temperature (above the rod midpoint temperature datum)

z, distance along rod, with origin at midpoint,

P, perimeter of the rod,

A, cross-sectional area of the rod, k, thermal conductivity of the rod, $R_\infty$, equivalent radial thermal resistance of the solid surrounding the rod (a function of $k_\infty$), $k_\infty$, solid thermal conductivity, and $t_\infty$, the linear lateral temperature variation (above the rod midpoint temperature datum) in the solid at a radial distance, $r_o$, sufficiently great so that the presence of the rod does not influence it.

The temperature variation in the solid is given by, $$t_\infty = bz \quad (2)$$

where the parameter, b, is the undisturbed vertical temperature gradient of the solid (earth). Thus Equation (1) can be expressed as $$\left(\frac{d^2}{dz^2} - C\right) t = -Bz \quad (3)$$

where $$C = P/R_\infty kA$$

$$B = Pb/R_\infty kA$$

The complimentary solution of Equation (3), $t_c$, is $$t_c = c_1 e^{-\sqrt{C}z} + c_2 e^{\sqrt{C}z} \quad (4)$$

The particular solution of Equation (3), $t_p$, can be obtained using the method of undetermined coefficients, namely, let $$t_p = c_3z^2 + c_4z + c_5 \quad (5)$$

Substituting Equation (5) into (3) yields $$\left(\frac{d^2}{dz^2} - C\right)(c_3z^2 + c_4z + c_5) = -Bz$$

or $$2c_3 - Cc_3z^2 - Cc_4z - Cc_5 = -Bz \quad (6)$$

Thus, the coefficients in Equation (5) became, $$\left.\begin{aligned} c_3 &= 0 \\ c_4 &= \frac{B}{C} \\ c_5 &= 0 \end{aligned}\right\} \quad (7)$$

Therefore, the complete solution of Equation (3) is the sum of Equations (4) and (5), $$t = c_1 e^{-\sqrt{C}z} + c_2 e^{\sqrt{C}z} + \frac{B}{C} z \quad (8)$$

One boundary condition for this problem is t=0 at z=0. Thus, $$C_2 = -c_1 \quad (9)$$

and $$t = c_1\left(e^{-\sqrt{C}z} - e^{\sqrt{C}z}\right) + \frac{B}{C} z \quad (10)$$

The second boundary condition for this problem defines the heat loss from the end of the rod (at z=l), namely, $$-k\left(\frac{dt}{dz}\right)_l A = \frac{1}{R_e}(t_l - bl)A \quad (11)$$

where $R_e$ is the equivalent end thermal resistance of the solid surrounding the rod. Upon substituting Equation (10) into (11), there results $$-k\left[c_1\left(-\sqrt{C}\, e^{-\sqrt{C}l} - \sqrt{C}\, e^{\sqrt{C}l}\right) + \frac{B}{C}\right] = \frac{1}{R_e}\left[c_1\left(e^{-\sqrt{C}l} - e^{-\sqrt{C}l}\right) + \frac{B}{C}l - bl\right]$$

or $$c_1 = \frac{-b}{-\sqrt{C}\left(e^{-\sqrt{C}l} + e^{\sqrt{C}l}\right) + \frac{1}{kR_e}\left(e^{-\sqrt{C}l} - e^{\sqrt{C}l}\right)} \quad (12)$$

where b is the vertical earth temperature gradient. It is also necessary to define the cylindrical and hemispherical thermal resistances of the solid surrounding the transducer, namely, $R_\infty$ and $R_e$, respectively. The resistance for the annulus surrounding the rod is $$R_\infty = \frac{r_i}{K_\infty} \ln \frac{r_o}{r_i} \quad (13)$$

where:

$r_o$, a radial distance from the rod centerline sufficiently great so that the presence of the rod does not influence it, i.e., a radial distance at which the vertical earth temperature gradient approaches the undisturbed value, $r_i$, radius of the rod, and $k_\infty$, thermal conductivity of the infinite solid.

The thermal resistance of the hemispherical earth shell at the end of the rod is $$R_e = \frac{r_i^2\left(\frac{1}{r_i} - \frac{1}{r_o}\right)}{K_\infty} \quad (14)$$

Thus, the complete temperature solution for the thin rod transducer is given by Equations (10), (12), (13) and (14). The solution contains two unknowns, namely, the thermal conductivity of the earth, $k_\infty$, and the vertical earth temperature gradient, b. These two unknowns can be evaluated by making steady state thermopile voltage measurements with two rod transducers of different, but known, thermal conductivities, low k and high k. The model also accounts for the effect of a fluid annulus between the transducer and the borehole wall on the temperature field.

Referring to FIG. 1, a rod heat-flux transducer 10 of the present invention is comprised of a long (six to nine feet) tube 12 about four inches in diameter and of thick wall. The tube is closed at the bottom by a plate 14, and closed at the head by a plate 16 to which a lowering cable 18 is attached. A thermopile 20 is enclosed in the tube, and electrically insulated therefrom with a material having a low thermal resistance for good thermal coupling of junctions in the thermopile to the tube.

Figure 2:
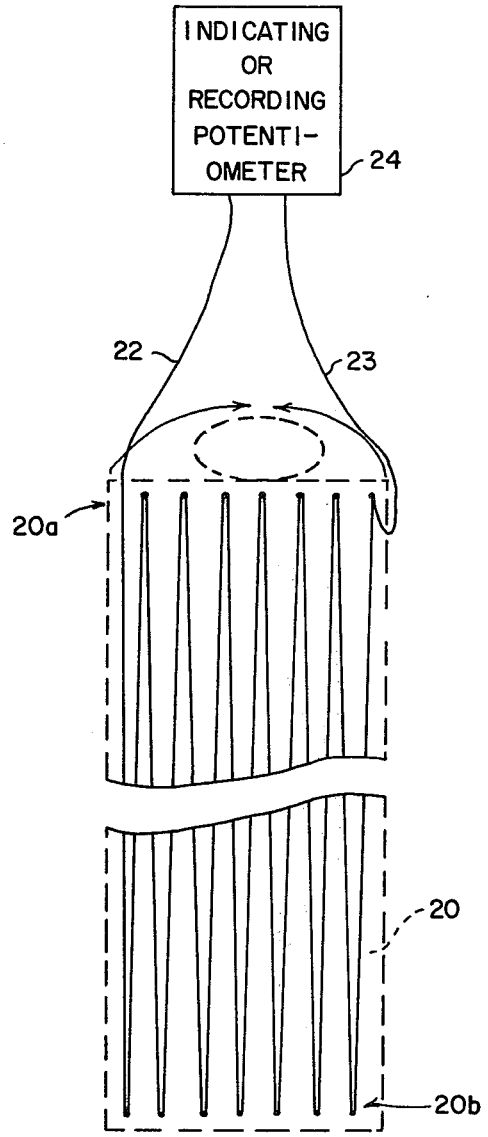
FIG. 2 illustrates an array of thermocouples connected in series to form a thermopile that is then formed into a cylinder for placement inside the transducer of FIG. 1 with electrical insulation and thermocoupling material between the junctions and body of the transducer.

FIG. 2 illustrates schematically the thermopile 20 having thermocouple junction sets 20*a* and 20*b* in series. A lead 22 connected at one end of the thermopile, and a lead 23 connected at the other end, extend up along the cable 18 to a potentiometer 24 at the surface of the earth where the potential generated by the thermopile is measured to determine the temperature gradient of the rod.

In practice, the thermopile consists of about 50 thermocouple junctions connected in series so that large output signals would be obtained without requiring voltage amplifications. The upper and lower junctions may be arrayed in a circle with opposing junctions connected in series by the conductors of dissimilar metals, forming a cylindrical arrangement to fit the inside of the tube. The thermopile is encased in the rod which is in turn sealed, as with O-rings, at each end to make it completely waterproof. In addition, the cable and the cable passage into the rod is made waterproof.

The tube 12 is made of a material having a known thermal conductivity. When a transducer having a high thermal conductivity k is lowered into a borehole and allowed to come to thermal equilibrium with the surrounding earth, heat flow in the earth in the vicinity of the borehole is distorted because the thermal conductivity is different from that of the earth, and causes heat flux in the earth to flow through the tube of higher thermal conductivity than the earth. The extent of flux distorted through the rod will depend upon the thermal conductivity of the surrounding earth, and the electrical output of the thermopile in essence measures this distortion.

This rod heat-flux transducer is unique because it can be used to measure geothermal heat flux in situ, i.e., without requiring a core sample to be taken for the purpose of measuring its thermal conductivity, and more importantly without requiring any thermal contact of the rod with the walls of the borehole. A fluid annulus of gas, water or mud surrounds the rod (tube 12). Calculations using the simpler closed form solution defined by Equations (8) through (14) show that when the thermal resistance of the fluid annulus is added to the cylindrical earth resistance surrounding the rod transducer, one can account for the thermal resistance of the annulus. The case of no annulus departs very little from the case of a small water annulus relative to the radius of the rod; the departure is greater with an air annulus.

It is desirable to have the annulus effect on the temperature field be relatively small. Then there will be less concern about possible uncertainties in the thickness of the annuli and the thermal properties of the fluid contained therein. A reasonable criterion to limit the annulus dimension is that the borehole to transducer radius range from 1.1 to 1.2, i.e., that the annulus thickness be about 10 to 20% of the borehole radius. In addition, it is desirable that the fluid be water or mud.

Figure 3:
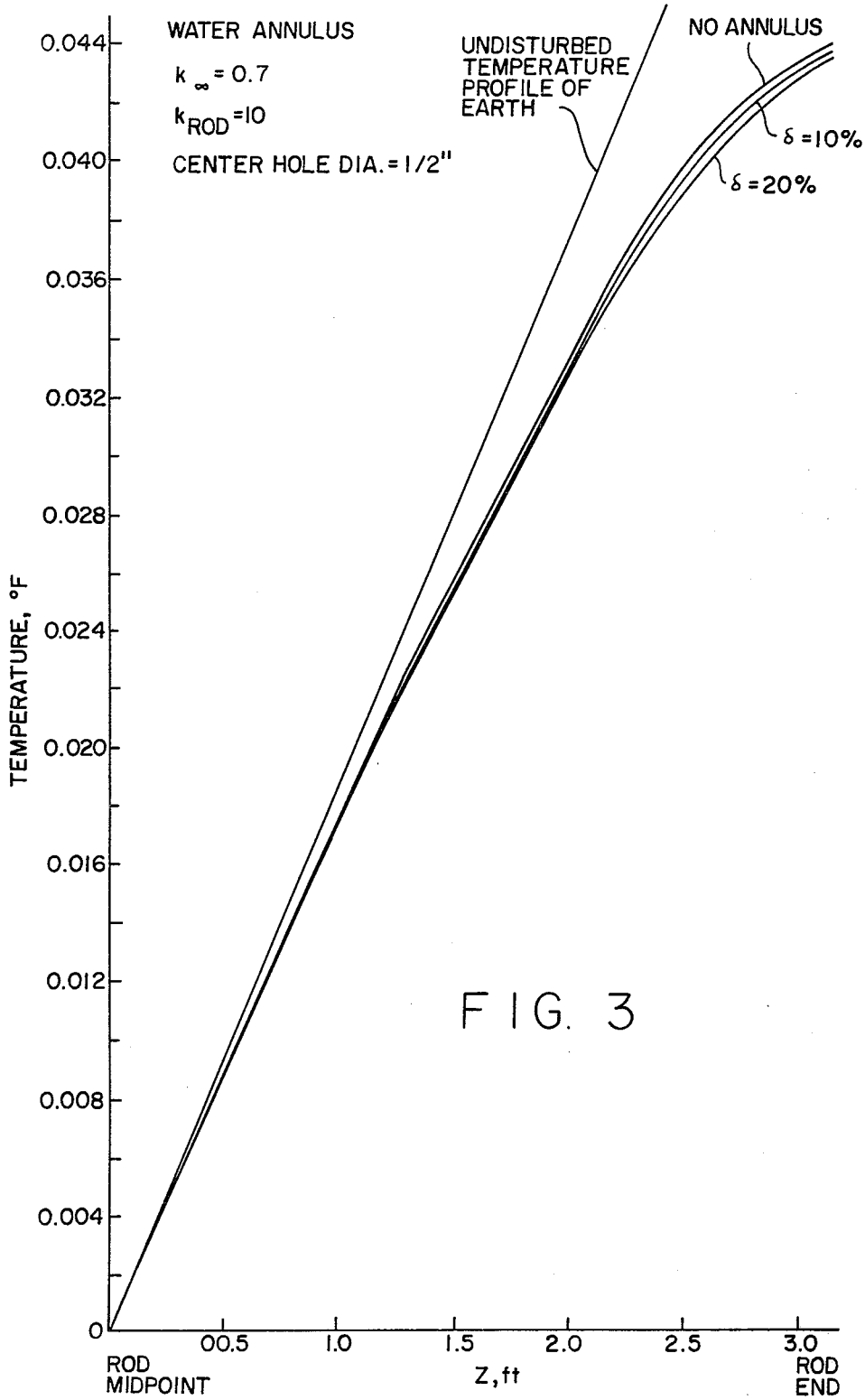
FIG. 3 shows the effect of a water annulus on the heat-flux transducer of FIG. 1.
Figure 4:
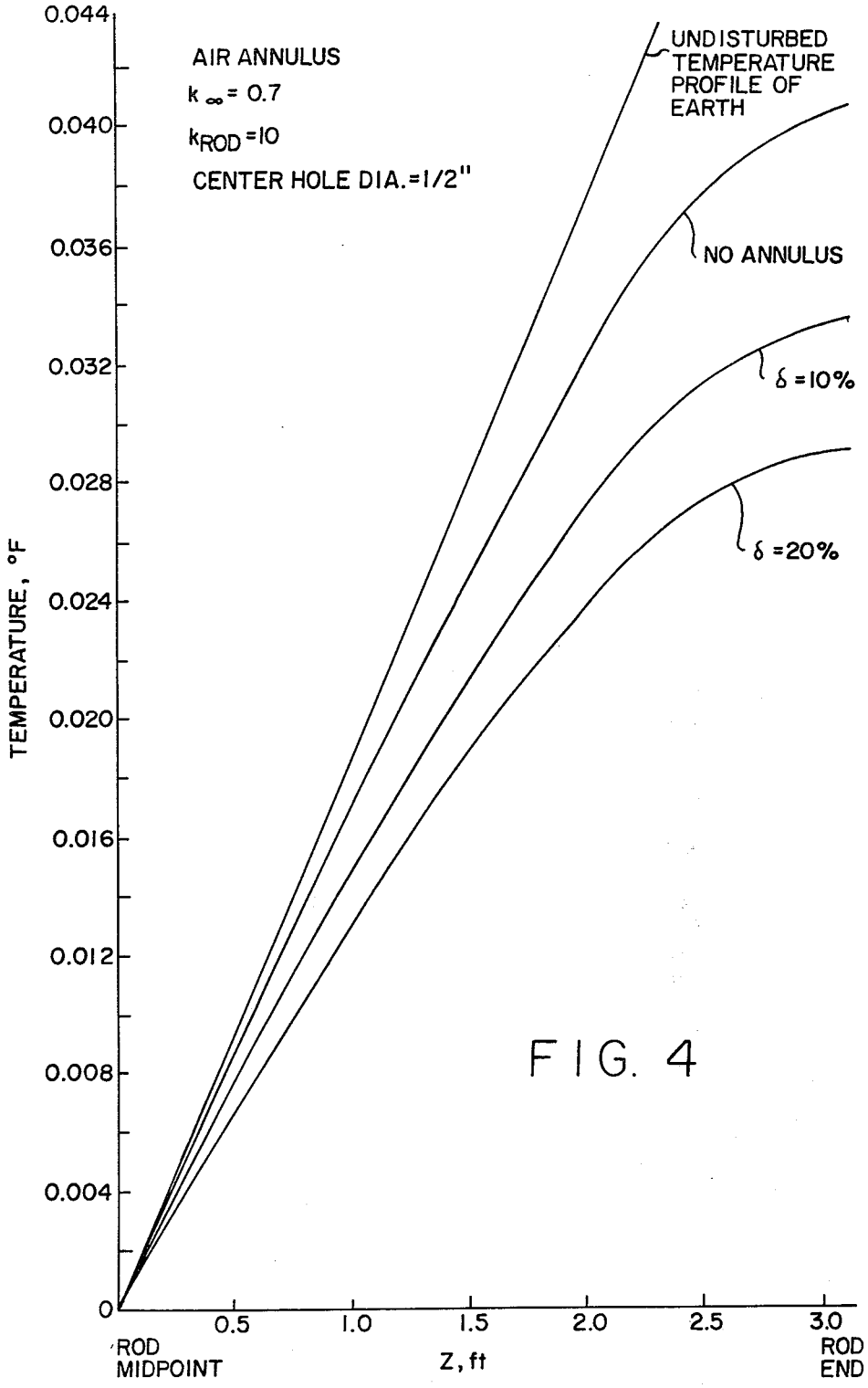
FIG. 4 shows the effect of an air annulus on the heat-flux transducer of FIG. 1.

Because the simpler closed-form solution, Equations (8) through (14), has been shown to be in satisfactory conformance with the numerical, two-dimensional heat transfer solutions, as referenced above (in the first paragraph of the description of preferred embodiments), the simpler closed form solution was used to perform the annulus analysis for the rod transducer. Specifically, the thermal resistance of the fluid annulus was added to the cylindrical earth resistance to obtain an increased value of $R_\infty$ for values of $k_\infty > k_a$, and $R_\infty$ is the equivalent radial thermal resistance of the earth surrounding the rod, and $k_a$ is the annulus thermal conductivity. Similarly, the effect of fluid at the ends of the transducer was also inclined resulting in an increased thermal resistance of the earth's hemispherical shell at the ends of the rod transducer for values of $k_\infty > k_a$. FIGS. 3 and 4 illustrate the effect of a water annulus and an air annulus as determined by this analysis.

Figure 5:
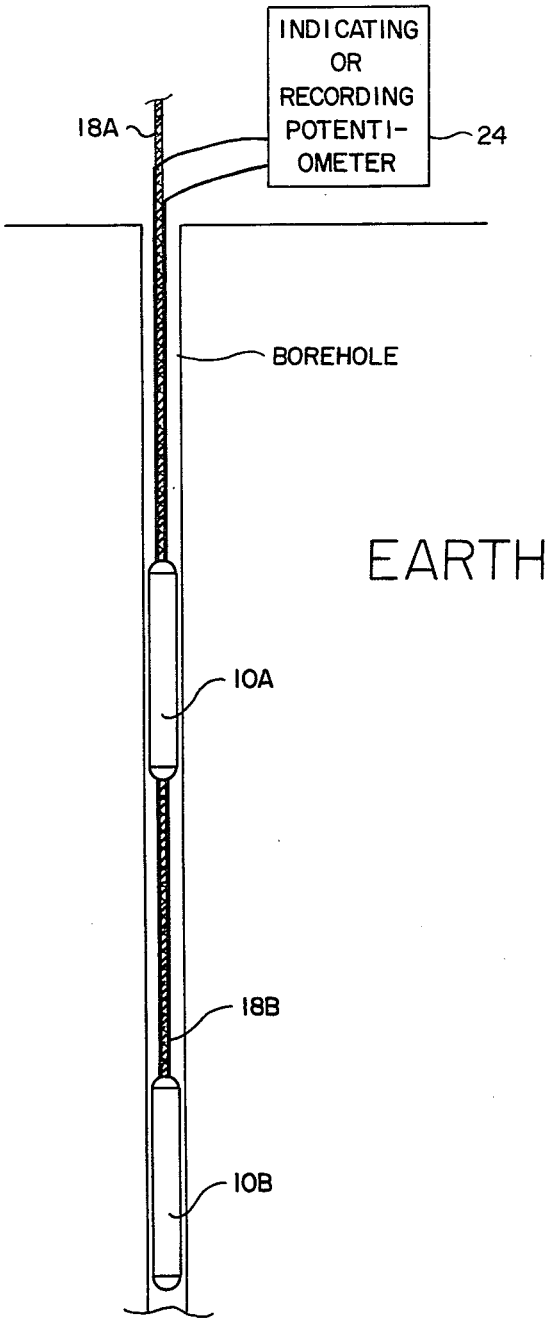
FIG. 5 illustrates the manner in which two transducers are lowered in a borehole in series to practice the method of this invention.

In operation, a first transducer is lowered to the test depth, and after thermal equilibrium, the thermopile output is read and/or recorded. Next, the first transducer is removed and a second transducer of different thermal conductivity is inserted for the second measurement. Alternatively, two rod heat-flux transducers 10A and 10B can be inserted simultaneously in a borehole, positioned in series but spaced one to two transducer lengths from each other, as shown in FIG. 5. One heat-flux transducer would have a known high thermal conductivity, $k_{high}$. The second heat-flux transducer would have a known low thermal conductivity, $k_{low}$. The latter conductivity could be near the value for that of the earth. In practice it is desirable to have a large difference in the high and low conductivities. Otherwise the signal ouputs could be degraded by thermal noise thus reducing the heat flux accuracy. While the second may be suspended from the first by a support cable 18B, the thermopile leads of the second pass over or through the first transducer and to the potentiometer. After the dual heat-flux transducer system has been lowered to its measurement depth and allowed to come to equilibrium, thermopile voltages of the two transducers are recorded. The interpretation of the voltage measurements to obtain the geothermal heat flux in the surrounding earth is then as follows.

The flow through the transducer with a known relatively high thermal conductivity has a two-dimensional temperature-heat flow field directly related to the system geometry, the transducer and earth conductivities, and the vertical temperature gradient in the earth at some distance, $r_o$, from the borehole. The vertical earth temperature gradient, which is required as a boundary condition in the solution, would, in essence, be determined by the second heat flux transducer which has a low thermal conductivity such that very little two-dimensional heat flow occurs in it; it would give the desired vertical earth temperature gradient at some distance from the borehole.

Figure 6:
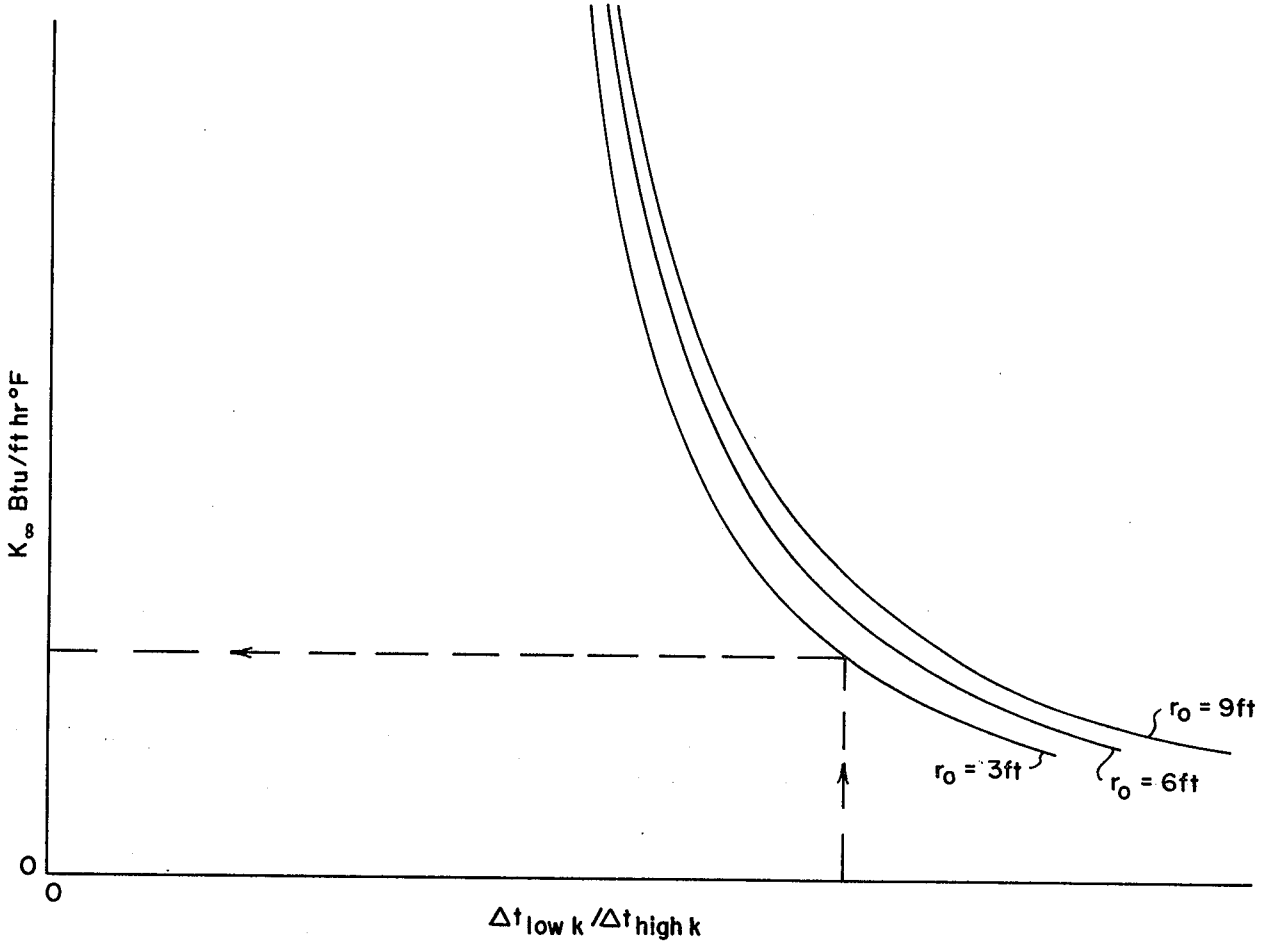
FIG. 6 is a graph which relates the ratio of thermal gradient sensed along a transducer of low conductivity and along a transducer of high conductivity to the earth's conductivity $k_\infty$.

From the foregoing it is evident that the equations for the temperature distribution along the rod heat-flux transducers are functions only of the thermal conductivity of the earth, the temperature gradient, and the physical characteristics of the transducers. If the temperature solution (Equation 8) for the high thermal conductivity rod transducer is divided by the temperature solution (Equation 8) for the low thermal conductivity transducer, a single equation results which uniquely relates the earth thermal conductivity, $k_\infty$, to the ratio of the thermopile voltages (temperature differences) and the radius $r_o$. In other words, the Equations (10) through (14) for the temperature distribution along the rod transducers are functions only of thermal conductivity of the earth, $k_\infty$, the temperature gradient, t, and the physical constants of the rod transducers. If the known physical constants for each of the two transducers are substituted into the equations, the resulting solution in terms of two unknowns, namely $k_\infty$ and t for one transducer can be divided by the solution for the other transducer in two unknowns, namely $k_\infty$ and t. This ratio is then only a function of the earth's thermal conductivity because the temperature gradient in the earth is common to both and cancels out. So the earth's thermal conductivity can be plotted as a function of the ratio of the experimental temperature differences $\Delta t$ as measured by thermopiles (or the voltage outputs of the thermopiles). It therefore follows that from the equations for the simpler closed form solution, values may be calculated for a range of the earth's thermal conductivity, $k_\infty$, as a function of temperature differences for rods of different, but known, thermal conductivities, $k_{high}$ and $k_{low}$. Note that a different curve results from each different assumed radius of influence, $r_o$, but that the radius of influence is not a sensitive parameter. FIG. 6 is a graph of such calculated values for transducers of known low and high conductivity.

Equation (8) involves two unknowns, namely B from Equation (3*a*) because $R_\infty$ (a function of $K_\infty$) is not known, and b in the coefficient c, given in Equation (12). Once $k_\infty$ is determined from the graph of FIG. 6, $R_\infty$ is computed from Equation (13). Equation (8) can then be solved for the one unknown, b, the undisturbed vertical temperature gradient of the earth. Once that is accomplished, it is only a matter of multiplying the thermal conductivity of the earth, $k_\infty$, and the undisturbed vertical temperature gradient, b, to obtain vertical heat flux ($k_\infty b$). So, once the earth conductivity, $k_\infty$, is plotted as a function of the calculated ratio of the thermopile temperature differences (or voltage differences) for the two separate rod transducers $\Delta t_{low\ k}$ and $\Delta t_{high\ k}$, the actual earth thermal conductivity can be determined from a ratio of two measurements $E_1 = \Delta t_{low\ k}$ and $E_2 = \Delta t_{high\ k}$, read and/or recorded by the potentiometer.

Thus the earth's thermal conductivity, $k_\infty$, is determined from the ratio of the thermopile signal outputs $E_1$ to $E_2$ using the graph of FIG. 6 for an assumed radius of influence, $r_o$, the simpler closed form solution can be used for one transducer rod to solve for b, the vertical earth temperature gradient. More specifically, once $k_\infty$ is determined B can be determined, and Equation (8) can be solved for one transducer rod to determine one unknown, namely $c_1$. The undisturbed vertical earth temperature gradient, b, is then determined from Equation (12). The product of $k_\infty$ and b thus determined yields the value of vertical heat flux at the location and depth of the transducers.

In summary, a method is disclosed for determining the earth's vertical heat flux using two transducers (elongated rods of different but known thermal conductivities, $k_{low}$ and $k_{high}$, and separate thermopiles for each rod). The transducers are positioned in a borehole at a depth of interest for a period sufficient for their rods to reach thermal equilibrium with the surrounding earth. The thermal gradients (thermopile temperature differences) of the rods along their lengths are measured to obtain two voltage measurements, $E_1$ and $E_2$. From those measurements, a ratio $E_1/E_2$ is obtained which relates the thermal gradient sensed along one transducer (rod and thermopile), and the low thermal conductivity of the one transducer rod, to the thermal gradient sensed along the other transducer (rod and thermopile), and the high thermal conductivity of the other transducer rod, to determine the vertical heat flux of the earth at the location and depth of the transducers. That is done by first determining the thermal conductivity, $k_\infty$, of the earth from that ratio using a precalculated graph which relates the ratio to the earth's thermal conductivity using the simpler closed form solution given by Equations (8) through (14), and then solving for the earth's undisturbed vertical temperature gradient, b, from the closed form solution for one rod transducer. The product $K_\infty b$ of the values thus determined from experimental temperature information yields the desired vertical heat flux information.

Although particular embodiments of the invention have been described and illustrated herein, it is recognized that modifications and variations may readily occur to those skilled in the art. Consequently, it is intended that the claims be interpreted to cover such modifications and equivalents.

What is claimed is:

1. A method of determining the earth's vertical heat flux using a borehole in a location of interest, comprising the steps of positioning in said borehole, at a depth of interest, a first elongated heat-flux transducer having a known thermal conductivity, maintaining said first transducer in position for a period sufficient to reach thermal equilibrium with its surroundings, said first transducer being thermally coupled to the earth primarily only through a fluid annulus, sensing the thermal gradient along said first transducer, positioning in said borehole at said depth of interest a second elongated heat-flux transducer having a known thermal conductivity different from that of the first transducer, maintaining said second transducer in position for a period sufficient to reach thermal equilibrium with its surroundings, said second transducer being thermally coupled to the earth primarily only through a fluid annulus, sensing the thermal gradient along said second transducer, and relating the thermal gradient sensed along said first transducer and the thermal conductivity of said first transducer to the thermal gradient sensed along said second transducer and the thermal conductivity of said second transducer to determine the vertical heat flux at the location and depth of interest.

2. The method as defined in claim 1 including the steps of repeating the process for determining vertical heat flux at one location for other locations in an area of interest and mapping the heat flux at each location to show the vertical heat flux distribution over the area.

3. A method of determining vertical geothermal heat flux in the earth using two elongated transducer rod sections of known thermal conductivity, one section having a higher thermal conductivity than the other, and each containing a thermopile for producing an electrical signal proportional to the temperature gradient between the ends of the section, including the steps of positioning said sections in a borehole at a depth at which heat flux is to be measured, one section being vertically displaced from the other, each transducer section being a cylindrical rod of a diameter less than the diameter of the borehole, with each section being thermally coupled to the surrounding earth primarily by only a fluid annulus, maintaining said sections in position for a period sufficient for said transducers to reach thermal equilibrium with their surroundings, measuring the amplitude of the electrical signal produced by said thermopile in each section at thermal equilibrium as a measure of thermal gradient in each, and relating the thermal gradient of one section thus measured and its known thermal conductivity to the thermal gradient of the other section thus measured and its known thermal conductivity to determine the vertical heat flux in the area surrounding the borehole at the depth of the average depth of the transducer.

4. The method as defined in claim 3 wherein vertical heat flux is determined by relating to a ratio of the thermal gradient of one section having relatively low thermal conductivity and the thermal gradient of the other section having high thermal conductivity, as a ratio of voltage signals produced by thermopiles of respective transducers, to the earth's thermal conductivity, $k_\infty$, from a graph of calculated values of $k_\infty$ as a function of ratio values, and from the actual value of the earth's thermal conductivity, $k_\infty$, determining the undisturbed vertical temperature gradient, b, from known parameters and temperature gradient of one rod section and from the values of $k_\infty$ and b, forming the product $k_\infty b$ to determine vertical heat flux.

5. The method as defined in claim 4 including the steps of repeating the process for determining vertical heat flux in one borehole for other boreholes spaced in an area of interest, and mapping the heat flux to show the vertical heat flux distribution of the area.

6. The method as defined in claim 3 wherein said fluid annulus is comprised of water or mud.

7. A heat-flux transducer for determining the vertical heat flux of the earth surrounding a borehole into which the transducer is to be inserted comprising a cylindrical rod of known thermal conductivity, and means within said rod for producing an electrical signal proportional to the heat gradient between the ends of the rod, wherein said rod has a diameter less than the diameter of said borehole, and said transducer is thermally coupled to surrounding earth by only a fluid annulus having a thickness that is in the range of 10–20% of the borehole radius.

8. A heat-flux transducer as defined in claim 7 wherein said signal producing means is comprised of a thermopile having one set of thermal junctions at one end of said rod, and the other set of thermal junctions at the other end.

9. A heat-flux transducer as defined in claim 8 wherein said rod is comprised of a tube and said two sets of thermal junctions are spaced around and arranged to be in thermal contact with, but electrically insulated from, the inside surface of said tube.

10. A method as defined in claim 9 wherein said fluid annulus is water.

11. A method as defined in claim 9 wherein said fluid annulus is mud.

12. A method for determining vertical heat flux of a geothermal field in the earth at a particular depth comprised of the steps of lowering a first elongated heat-flux transducer into a borehole in the earth and thermally coupling said first transducer to the surrounding earth by a fluid annulus, said first transducer being comprised of a length of tubing of low thermal conductivity relative to a second transducer with a thermopile for measuring the thermal gradient between the ends of the first transducer after it has been positioned at about said particular depth in said borehole for a period sufficient for the tube thereof to reach thermal equilibrium, obtaining a first thermal gradient measurement from said thermopile in said first transducer, lowering said second transducer into said borehole in the earth to approximately the same depth as said first transducer and thermally coupling said second transducer to the surrounding earth by a fluid annulus, said second transducer being comprised of a length of tubing of high thermal conductivity relative to the first transducer with a thermopile inside for measuring the thermal gradient between the ends of the second transducer after it has been positioned in said borehole for a period sufficient for the tube thereof to reach thermal equilibrium, obtaining a second thermal gradient measurement from said thermopile in said first transducer, obtaining a ratio of the first thermal gradient measurement to the second thermal gradient measurement, using said ratio to determine the earth's thermal conductivity, $k_\infty$, from a precalculated graph which relates $k_\infty$ to said ratio, using the value of thermal conductivity, $k_\infty$, thus determined, and both the temperature gradient of one transducer and its known parameters, to determine the vertical earth temperature gradient, b, from predetermined steady state heat balance equations, and from the values of thermal conductivity and vertical earth temperature gradient, producing a product of those values as a determination of actual vertical heat flux at said particular depth in said borehole.

13. A method as defined in claim 12, 10 or 11 wherein said first and second transducers are lowered into said borehole for said first and second thermal gradient measurements at the same time, but displaced vertically from each other.

* * * * *